United States Patent [19]

Toyoda et al.

[11] Patent Number: 4,504,198

[45] Date of Patent: Mar. 12, 1985

[54] ELECTROMAGNETIC PUMP

[75] Inventors: Akira Toyoda; Yasutsune Chiba, both of Tokyo, Japan

[73] Assignee: Taisan Industrial Co., Ltd., Tokyo, Japan

[21] Appl. No.: 456,502

[22] Filed: Jan. 7, 1983

Related U.S. Application Data

[63] Continuation of Ser. No. 185,359, Sep. 8, 1980, abandoned.

[51] Int. Cl.[3] ..... F04B 17/04; F04B 7/00

[52] U.S. Cl. ..... 417/417; 417/505

[58] Field of Search ..... 417/417, 416, 418, 456, 417/505

[56] References Cited

U.S. PATENT DOCUMENTS

| | | | |
|---|---|---|---|
| 3,437,044 | 1/1969 | Sanders et al. | 417/418 |
| 3,874,822 | 1/1975 | Nakamura | 417/417 |
| 4,252,505 | 2/1981 | Toyoda | 417/417 |

*Primary Examiner*—Richard E. Gluck

*Assistant Examiner*—Peter M. Cuomo

*Attorney, Agent, or Firm*—Kane, Dalsimer, Kane, Sullivan & Kurucz

[57] ABSTRACT

An electromagnetic pump of the built-in electromagnetic valve type including an electromagnetic plunger actuating electromagnetic coil and an electromagnetic valve operating electromagnetic coil disposed co-axially in adjacent relationship and having magnetic paths of their own separated from each other by a non-magnetic portion, to obtain a desired magnetic flux distribution. The two electromagnetic coils have the same direction of windings to obtain an improved magnetic flux distribution, thereby providing improved pump operation. By passing a half-wave rectified current or a pulse current of a predetermined cycle to the two electromagnetic coils connected in series with each other, a magnetic flux can be produced in each electromagnetic coil and made to flow in the magnetic path exclusive to each electromagnetic coil, so that mutual interference of the magnetic fluxes produced by the two electromagnetic coils can be avoided.

3 Claims, 7 Drawing Figures

ELECTROMAGNETIC PUMP

This is a continuation of application Ser. No. 185,359, filed Sept. 8, 1980, now abandoned.

BACKGROUND OF THE INVENTION

This invention relates to an electromagnetic pump of the type having a built-in electromagnetic valve driven by a cyclically, intermittently supplied periodic current, such as a half-wave rectified current, a pulse current having a predetermined cycle, etc.

Heretofore, when a liquid disposed at a higher level than a pump is introduced into the pump for delivering the liquid under pressure or when a liquid disposed at a lower level than a pump is sucked into the pump for delivering the liquid under pressure, there has occurred a leak of the liquid due to the suction valve or discharge valve being opened by the pressure applied by the head of the liquid as the pump is rendered inoperative. In such occasion, the liquid not only has leaked but also has been ejected until the discharge pressure of the pump has dropped. Such phenomenon tends to cause a fire, production of an offensive smell or noxious gas due to incomplete combustion or explosion when the pump is an electromagnetic pump used with gun-type gas burner or other burner equipment wherein a fuel oil is supplied by the electromagnetic pump and burned after being ejected in jet streams under pressure. Incomplete combustion also causes deposition of soot on the nozzle of the burner and the nozzle becomes obturated, making it possible to eject the gaseous fuel in jet streams are required. This greatly reduces the reliability and the safety of use of the pump.

As a means for preventing such trouble, an electromagnetic value of an entity separate from the electromagnetic pump may be mounted on the suction side or discharge side of the pump. However, this requires more space than is necessary for mounting the electromagnetic valve and increases cost. Therefore, to avoid this disadvantage, proposals have been made to mount an electromagnetic valve in the electromagnetic pump structure.

Electromagnetic pumps having a built-in electromagnetic valve are disclosed, for example, in U.S. Pat. No. 3,874,822 (Japanese Patent Publication No. Sho 52-38243 and Japanese Utility Model Application Laid-Open Number Sho 54-159314 which corresponds to U.S. Pat. No. 4,252,505.

Electromagnetic pumps of the prior art having a built-in electromagnetic valve generally have a construction wherein a single electromagnetic coil produces a magnetic flux for actuating the pump and an electromagnetic flux for operating the electromagnetic valve or wherein a plurality of electromagnetic coils are arranged coaxially in adjacent relationship and the magnetic path for the magnetic fluxes produced by the two coils is in part shared by the two coils. In the electromagnetic pumps of the prior art having a built-in electromagnetic valve using a single coil or a plurality of coils having a common magnetic path, difficulties have been encountered in producing an optimum magnetic flux for each of the electromagnetic plunger and the electromagnetic valve operating movable member. As a result, in the electromagnetic pump using a single coil, microvibrations occur due to repeated attraction and repulsion of the electromagnetic valve operating movable member by the magnetic head caused by intermittent supply of a magnetic force of a periodic current energizing the coil and restitution elasticity of the return spring, causing noise or damage due to chattering. In the electromagnetic pump using a plurality of coils and having a common magnetic path, mutual interference of the magnetic fluxes produced by the two coils has the risk of preventing the electromagnetic valve and/or pump from operating in a normal fashin.

SUMMARY OF THE INVENTION

The electromagnetic pump of the built-up electromagnetic valve type according to the invention has a construction wherein an electromagnetic coil for actuating the electromagnetic pump and an electromagnetic coil for operating the electromagnetic valve are formed separately and disposed coaxially in such a manner that a non-magnetic portion is interposed between the two coils to separate a magnetic path for one coil from a magnetic path for the other coil, to thereby avoid mutual interference of magnetic fluxes produced by the two coils. The two electromagnetic coils advantageously have the same direction of windings and are connected in series with each other. However, the coils maybe connected in parallel depending on the used voltage and other conditions.

By virtue of this construction, the two electromagnetic coils of the electromagnetic pump of the built-in electromagnetic valve type according to the invention which are disposed coaxially magnetically function independently of each other although they are electrically connected to each other. Thus there is considerable latitude in designing and forming magnetic paths for the two coils which optimally define the magnetic path distribution or the conditions of magnetic paths. This is conducive to increased operation efficiency and improved reliability of the electromagnetic valve and the electromagnetic plunger.

The construction of the electromagnetic coils according to the invention enables a compact overall size to be obtained in an electromagnetic coil by using a wire of the same diameter and reducing the numer of turns. This is conducive to saving of labor and time and reduced cost in production.

According to a preferred embodiment of the invention, a reduced cross-sectional area portion may be provided in a portion of an annular magnetic path on the center axis of the two electromagnetic coils that corresponds to the non-magnetic portion. The provision of the reduced cross-sectional area portion further increases the effects achieved by separation of the magnetic paths for the two electromagnetic coils from each other. The reduced cross-sectional area portion can be obtained by forming a groove on the outer periphery of the annular magnetic path.

The electromagnetic pump of the built-in electromagnetic valve type provided by the invention satisfactorily combines the function of an electromagnetic pump with that of an electromagnetic valve. Thus the invention permits the aforesaid disadvantages of the prior art to be obviated by reducing the space required for mounting the electromagnetic pump and its cost.

Accordingly, one object of the invention is to provide an electromagnetic pump of the built-in electromagnetic valve type obviating the disadvantages of the prior art which effectively utilizes produced magnetic fluxes to increase operation efficiency of the pump and improve it reliability in performance.

Another object is to provide an electromagnetic pump of the built-in electromagnetic valve type which uses magnetic paths of rational shape for the pump and the valve to enable the magnetic paths for the pump and valve to be separated from each other without any trouble.

Additional and other objects, features and advantages of the invention will become apparent from the description set forth hereinafter when considered in conjunction with the accompanying drawings.

DESCRIPTION OF THE PREFERRED EMBODIMENT

Figure 1:
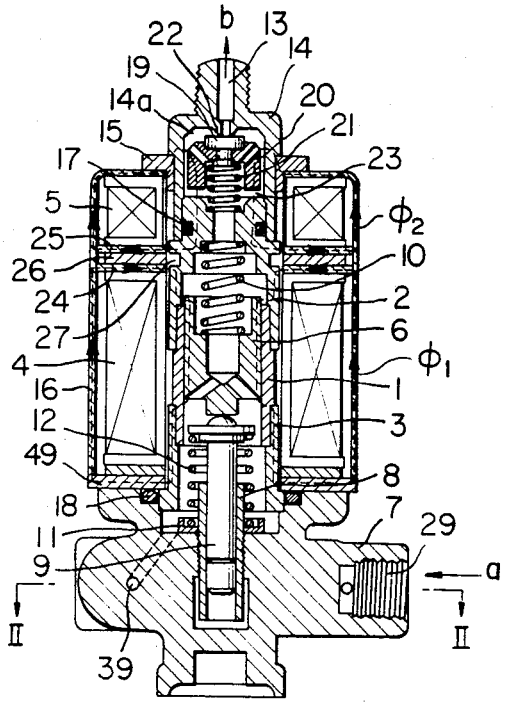
FIG. 1 is a vertical sectional view of the electromagnetic pump of the built-in electromagnetic valve type comprising one embodiment of the invention.
Figure 2:
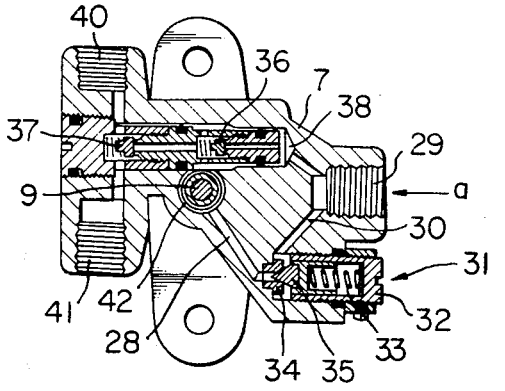
FIG. 2 is a sectional view taken along the line II—II in FIG. 1.

FIG. 1 is a vertical sectional of the electromagnetic pump according to the invention, and FIG. 2 is a sectional view taken along the line II—II in FIG. 1.

The electromagnetic pump comprises a plunger case 1 formed of a non-magnetic material including an upper portion in which an upper annular magnetic path 2 is provided, and a lower portion in which an annular magnetic pole 3 is provided. The electromagnetic pump further comprises a coil 5 for operating the valve disposed around the upper portion (annular magnetic path 2) of the plunger case 1, and a coil 4 for actuating an electromagnetic pump disposed around the lower portion (annular magnetic pole 3) of the plunger case 1, the coils 4 and 5 being disposed coaxially in adjacent relationship.

The coil 4 for actuating the pump and the coil 5 for operating the valve may be electrically connected with each other in series or in parallel with their windings being oriented in the same direction. When the coils 4 and 5 are connected in series with each other, the impedance as viewed from the opposite ends of the coils becomes greater than when the coils 4 and 5 are connected in parallel with each other. Thus the need to increase the number of turns of both pump actuating coils 4 and 5 to avoid a rise in temperature is eliminated and the ampere-turn necessary for actuating the pump and the valve respectively can be used, so that it has economical value. Moreover, since the same type of wire can be used, the coil winding step can be simplified and production cost can be reduced. However, the wires used for the coils 4 and 5 may differ from each other in diameter.

Figure 3:
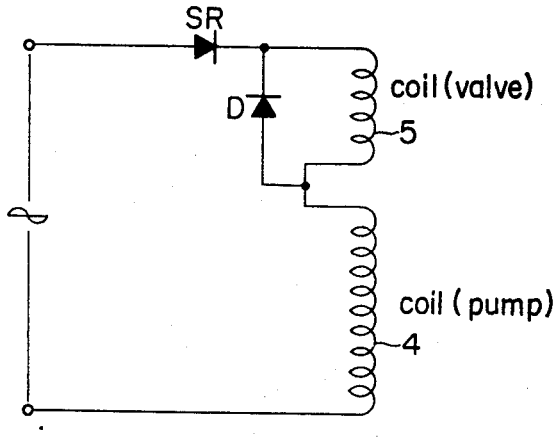
FIG. 3 is a diagram showing a connection circuit for improving characteristics of the electromagnetic pump shown in FIG. 1.

When the electromagnetic pump is driven by pulses obtained by subjecting an AC power source to half-wave rectification, excellent characteristics can be provided by using a connection circuit as shown in FIG. 3. More specifically, the circuit includes a power source half-wave rectifying diode SR connected to a power source in a manner to pass a current from the power source to the electromagnetic valve operating coil 5, and a second diode D of the polarity shown in FIG. 3 connected in series with the electromagnetic valve operating coil 5. The second diode D which functions as a so-called flywheel diode produces a counter electromotive force for the electromagnetic valve operating coil 5 during one half of the alternating current cycle in which passing of current is interrupted, with a result that the magnetic flux in an iron core produced when a current is passed to the coil 5 can have its magnetomotive force reduced at a lower speed which would otherwise be reduced instantly or at a high speed when passing of the current is interrupted. By this feature, an electromagnetic movable member can be positively attracted to and kept in contact with an attracting surface.

The electromagnetic pump further comprises an electromagnetic plunger 6 contained in the plunger case 1 for slidable reciprocatory movement, and a discharge plunger 9 inserted in a cylinder 8 screwed in a main body 7 for slidable reciprocatory movement, the discharge plunger 9 being disposed below the electromagnetic plunger 6 via a tappet. An auxiliary spring 10 is mounted between the bottom of a hollow space in the electromagnetic plunger 6 and the shoulder of an upper portion of the upper annular magnetic path 2, and a return spring 12 is mounted between the discharge plunger 9 and a spring seat 11 on the main body 7, so that the electromagnetic plunger 6 and discharge plunger 9 can be balanced and kept stationary within the plunger case 1 by the biasing force of the springs 10 and 12.

The upper annular magnetic path 2 has threadably connected to its upper end a discharge coupling 14 formed with an axial bore 13 and clamping a magnetic washer 15 to an upper surface of an outer casing 16. O-rings 17 and 18 are mounted between the upper annular magnetic path 2 and the discharge coupling 14 and between the lower annular magnetic pole 3 and the main body 7 respectively to ensure that the interior of the pump is kept airtight.

The discharge coupling 14 is formed with a cavity 14*a* containing an electromagnetic movable member 20 mounting a valve 19. The electromagnetic movable member 20 which is urged by the biasing force of a spring 21 mounted between the coupling 14 and the top of the upper annular magnetic path 2 is brought into pressing engagement with a valve seat 22 of the valve 19 to close same when the pump is operated. In this condition, a gap is formed between the electromagnetic movable member 20 and an attracting surface 23 of the upper annular magnetic path 2 which functions as a magnetic pole for attracting the electromagnetic movable member 20.

The construction described hereinabove is known as an electromagnetic pump of the solenoid type. The electromagnetic pump according to the invention has the following structural feature. A magnetic paths 24 and 25 between the pump actuating coil 4 and the valve operating coil 5 are separated from each other by a non-magnetic portion 26 and the cross-sectional area of the upper annular magnetic path 2 is reduced in a position corresponding to the non-magnetic portion 26 such as groove. For example, a groove 27 may be formed in the outer-periphery of the upper annular magnetic path in a position corresponding to the non-magnetic portion 26 as shown in FIG. 1. The provision of the modification of the groove 27 increases magnetic resistance and adjusts a separation of the magnetic fluxes produced in the coils 4 and 5 entering the magnetic loops of the coils 5 and 4 respectively, thereby further reducing the risks of magnetic interference.

By virtue of this structural feature, the majority of the magnetic flux produced in the pump actuating coil 4 flows through the magnetic path 24→electromagnetic plunger 6→lower annular magnetic pole 3→lower plate 49→outer casing 16→or along a first magnetic loop $\Phi_1$, and the magnetic flux produced in the valve operating coil 5 flows through the magnetic path 25→outer casing 16→magnetic washer 15→electromagnetic movable member 20→upper annular magnetic path (magnetic pole) 2→or a second magnetic loop $\Phi_2$. Thus the magnetic fluxes produced in the coils 4 and 5 are prevented from entering the magnetic paths of the magnetic fluxes of the coils 5 and 4 respectively, so that mutual interference of the magnetic fluxes of the coils 4 and 5 can be avoided and the reliability of the pump in performance can be increased.

Independence of the magnetic paths 24 and 25 from each other enables phenomenon of magnetic saturation to be avoided, thereby improving the performance of the pump.

The non-magnetic portion 26 may be in the form of a non-magnetic material, such as synthetic resin or non-magnetic metal plate, or a layer of air interposed between the magnetic paths 24 and 25 formed of sheet iron or other magnetic material.

To increase the aforesaid magnetic path separating action of the non-magnetic portion 26, a portion of the upper annular magnetic path 2 corresponding to the non-magnetic portion 26 may be severed and the non-magnetic metal material or synthetic resinous material may be used to connect the cut ends of the magnetic path 2. However, difficulties are experienced in working the magnetic path 2 and hence cost is increased.

Referring to FIG. 2, a relief valve assembly 31 is mounted on the suction side of the pump in a cavity formed in an adjusting screw 32 secured to the main body 7 and comprises a relief valve 35, and a spring 33 urging the relief valve 35 by its biasing force against a valve seat 34. The relief valve assembly 31 communicates through a duct 28 with a pressure chamber 42 communicating with the cylinder 8, and through a leak duct 30 with a suction port 29.

The suction port 29 communicates through a duct with a valve chamber 38 having a suction valve 36 and a discharge valve 37. The discharge valve 37 communicates at its outlet portion with the plunger case 1 through a duct 39 formed in the main body 7.

40 and 41 designate threaded portions each for threadably connection with a coupler. When the electromagnetic valve mechanism is not required, the discharge port 13 may be closed and either one of the threaded portions 40 and 41 may be used as a discharge port. However, the threaded portions 40 and 41 are normally used for connection with an accumulator and a pressure gauge for measuring the internal pressure of the pump. When not used, the threaded portions 40 and 41 are closed by plugs.

Operation of the electromagnetic pump of the aforesaid construction will now be described. A pulse current obtained by subjecting a current from a commercially available power outlet to half-wave rectification or other system of switching is supplied to the pump actuating coil 4 and valve operating coil 5. Energization of the pump operating coil 5 forms the second magnetic loop $\Phi_2$ magnetic path 25→magnetic washer 15→upper annular magnetic path (magnetic pole) 2. The electromagnetic movable member 20 is moved by the magnetic attracting force by overcoming the biasing force of the spring 21 in a direction in which the magnetic resistance of the second magnetic loop $\Phi_2$ is minimized or in a direction in which the magnetic gap is filled, to be attracted to the attracting surface 23 of the upper annular magnetic path 2 functioning as a magnetic pole. This moves the valve 19 away from the valve seat 22, to thereby open the discharge port 13.

Simultaneously as the coil 5 is energized, the electromagnetic oil 4 for actuating the pump is energized to form the first magnetic path $\Phi_1$ magnetic path 24→upper annular magnetic path 2→electromagnetic plunger 6→lower annular magnetic path 3→lower plate 49→outer casing 16. Thus the electromagnetic plunger 6 is vertically moved in sliding reciprocatory movement in the plunger case 1 by the alternatingly repeated actions of an intermittently produced magnetic force which represents a sum of the attracting force of the solenoid acting in the plunger case 1 and the magnetic attracting force of the lower annular magnetic pole 3 and the biasing forces of the springs 10 and 12. Coupled to the plunger 6, the discharge plunger 9 also vertically moves in sliding reciprocatory movement in the cylinder 8, with a result that a liquid is sucked in a direction a shown in FIG. 1 through the suction port 29 and introduced through the suction valve 36, discharge valve 37 and duct 39 into the plunger case 1, from which the liquid flows through the hollow space defined by the annular magnetic path 2 and ducts formed in the electromagnetic movable member 20, to be discharged through the discharge port 13 in a direction b shown in FIG. 1.

As the discharge pressure of the pump increases and a predetermined pressure level is about to be exceeded, excess liquid flows from the path of pressure liquid in the pump through the duct 28 to the relief valve assembly 30, from which excess liquid flow is returned through the leak duct 30 to the suction port 39, thereby effecting adjustments of the pressure in the pump.

In the present invention, the magnetic paths 24 and 25 between the pump actuating coil 4 and the valve operating coil 5 are separated from each other by the non-magnetic portion 26. This minimizes magnetic interference between the two coils 4 and 5 and enables the electromagnetic movable member 20 and the electromagnetic plunger 6 to be operated efficiently by the magnetic fluxes flowing through the magnetic loop $\Phi_1$ and $\Phi_2$ respectively, thereby enhancing the dependability of the pump in performance. The effects achieved by separation of the magnetic paths 24 and 25 from each other are further increased by the provision of the reduced cross-sectional area portion in the annular magnetic path 2.

In the invention, the pump actuating coil 4 and the valve operating coil 5 are arranged coaxially in adjacent relationship, and the windings of the coils 4 and 5 are oriented in the same direction. A current is supplied to the coils 4 and 5 in such a manner that the magnetic fluxes flowing through the magnetic paths 24 and 25 are oriented in the opposite directions. By this arrangement, the action of the magnetic paths 24 and 25 to cancel out the residual magnet permits the electromagnetic movable member 20 to be quickly and positively released from the attracting surface 25 when a circuit is formed to connect the coils 4 and 5 to the power source. Also, the trouble of the magnetic fluxes in the magnetic paths 24 and 25 interfering with each other by entering the adjacent magnetic paths when a current is passed to the pump can be avoided, thereby ensuring that the electromagnetic pump and electromagnetic valve can operate smoothly.

As aforesaid, the magnetic paths 24 and 25 between the coils 4 and 5 are separated from each other by the non-magnetic portion 26. In this arrangement, when the two coils 4 and 5 are energized by a half-wave rectified current or other intermittent current, a magnetic force caused by an induced electromotive force of phase delay is produced in the vicinity of the attracting surface 23 of the upper annular magnetic path 2 each time the supply of current is interrupted for one half of the alternating current cycle. The magnetic force produced supplements the magnetic force which tends to disappear when the supply of current is interrupted, so that the electromagnetic movable member 20 tends to be kept in contact with the attracting surface 23 and the magnetic force disappears only for a short period of time. Thus the electromagnetic movable member 20 can be continuously maintained in contact with the attracting surface 23 even during the one half cycle of the alternating current in which the supply of current is interrupted. Thus chattering or humming of the electromagnetic movable member 20 can be inhibited, damage to the electromagnetic movable member 20 and attracting surface 23 can be avoided, and wear on the valve 19 and valve seat 22 can be prevented.

Figure 4:
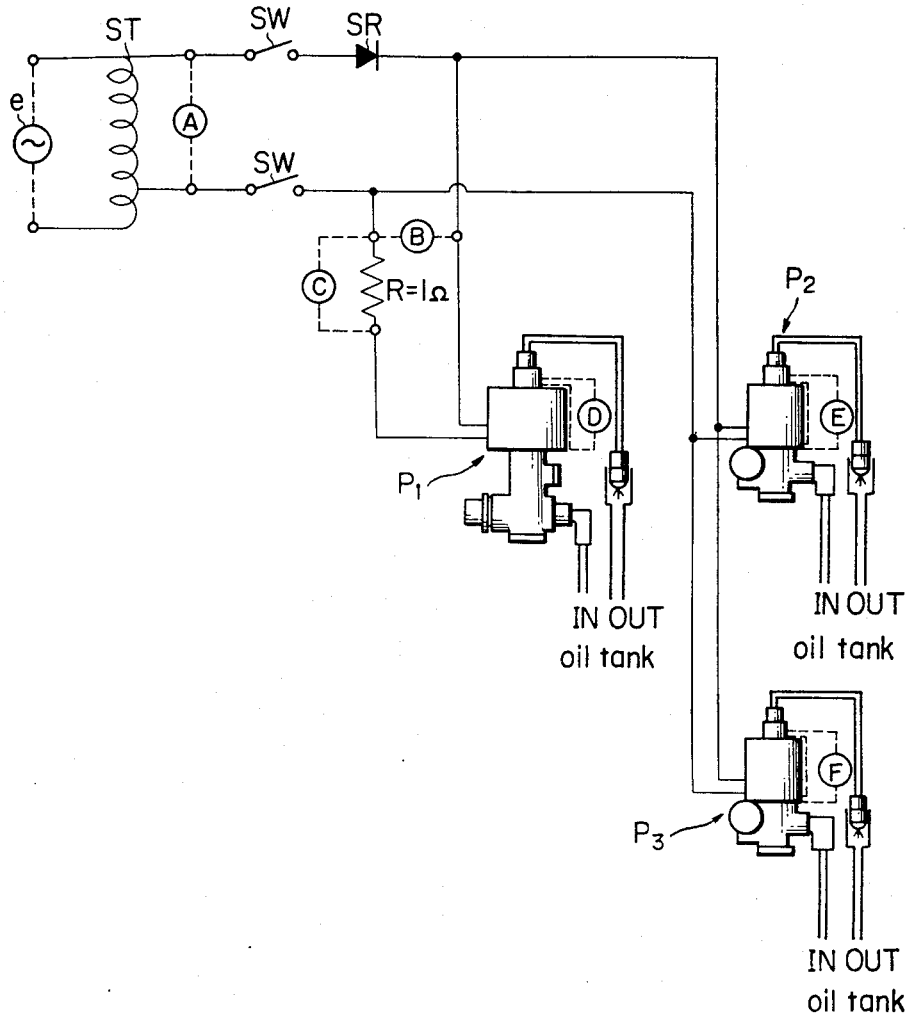
FIG. 4 is a diagram of the circuit used for conducting tests on the electromagnetic pump shown in FIG. 1 to ascertain the effects achieved thereby.

The results of tests conducted on the electromagnetic pump of the aforesaid construction according to the invention will be described. FIG. 4 shows the circuit used in the tests including an AC power source e of 100 V and 50 Hz, a variable autotransformer ST, a diode SR for effecting half-wave rectification, and a resistor R of 1Ω for obtaining wave forms of current. A first pump $P_1$ is an electromagnetic pump shown in U.S. Pat. No. 3,874,822 (Japanese Patent Publication No. Sho 52-38243) which uses a single coil for actuating the pump and operating the electromagnetic valve. A second pump $P_2$ which is shown in Japanese Utility Model Application Laid-Open Number Sho 54-158314 which corresponds to U.S. Pat. No. 4,252,505 is an electromagnetic pump using separate coils for actuating the pump and operating the electromagnetic valve and a common magnetic path shared by the two coils. A third pump $P_3$ is the electromagnetic pump according to the invention.

Figure 5A:
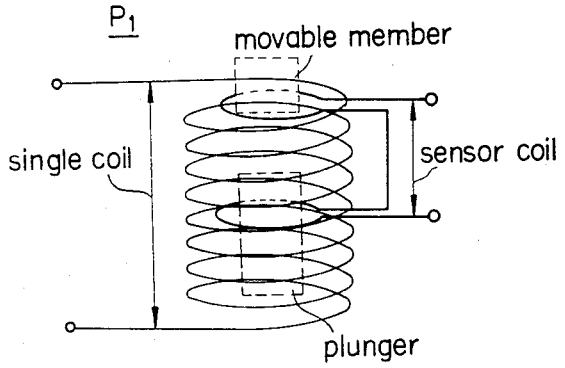
FIGS. 5(*a*) and 5(*b*) are views in explanation of the manner in which a sensor is connected to the electromagnetic pump.
Figure 5B:
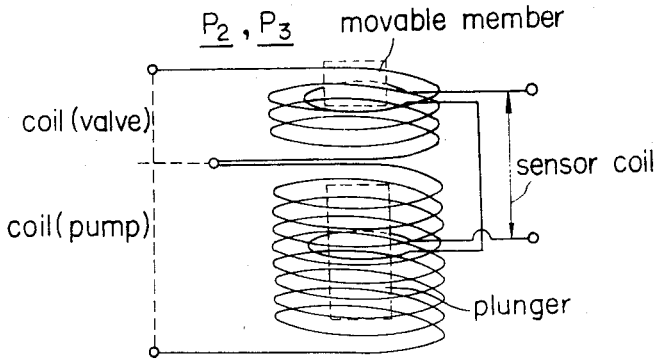

In FIG. 4, broken lines A to F connect together points at which tests were conducted to obtain wave forms. The points D, F and F each represent opposite ends of a sensor coil inductively connected to the electromagnetic coils of the pumps $P_1$, $P_2$ and $P_3$ respectively as shown in FIGS. 5(*a*) and 5(*b*).

Figure 6:
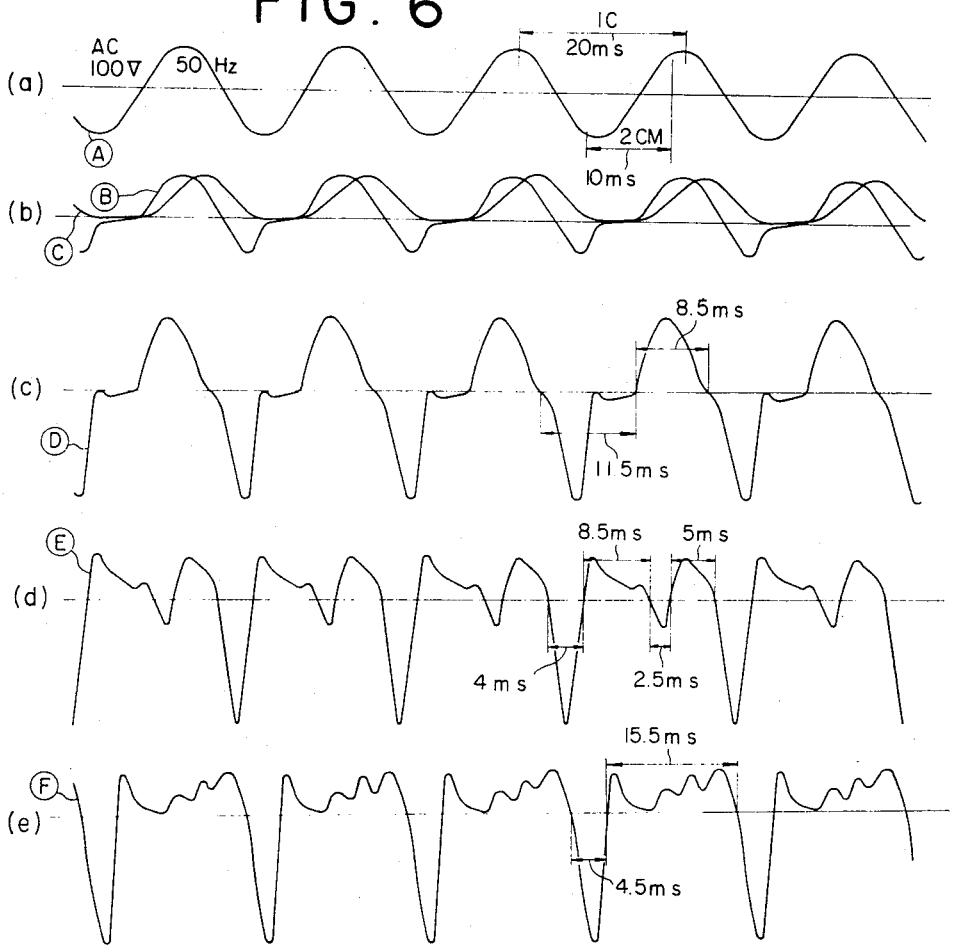
FIGS. 6(*a*)–6(*e*) are diagrams showing wave forms of voltages in various sections of the circuit shown in FIG. 4.

FIGS. 6(*a*)–6(*e*) show wave forms obtained at the testing points A - F . A wave form A shown in FIG. 6(*a*) represents and AC current of 100 V and 50 Hz with a cycle of 20 m-sec. When this current is half-wave rectified by the diode SR for driving the electromagnetic pump $P_1$, $P_2$ and $P_3$, an inductive load is applied to each pump, so that, as shown in FIG. 6(*b*), the phase of a wave form C of current at the testing point C is delayed about 5 m-sec. as compared with the phase of a wave form B of current at the testing point B . Also, a counter electromotive force is produced the instant the voltage becomes zero. A minus portion of the wave form R indicates a counter electromotive force. The counter electromotive force produces no current that can be utilized.

Wave forms shown in FIGS. 6(*c*)–6(*e*) will be compared with each other. In the electromagnetic pump of the single coil type $P_1$ disclosed in U.S. Pat. No. 3,874,822 (Japanese Patent Publication No. Sho 52-38243), the magnetic force is non-existent for a period of 11.5 m-sec. out of one cycle of 20 m-sec. or as high as 75% of the total period of one cycle as shown in FIG. 6(*c*). The electromagnetic pump $P_2$ shown in Japanese Utility Model Application Laid-Open Number Sho 54-159314 using separate coils for actuating the pump and operating the valve and a common magnetic path for the two coils has as shown in FIG. 6(*d*), a period of $4+2.5=6.5$ m-sec. in which no magnetic force is produced. This represents 25% of the 20 m-sec. of one cycle, showing an improvement over the pump $P_1$.

FIG. 6(*e*) shows a wave form F of the current in the electromagnetic pump $P_3$ according to the invention in which a period of non-existence of the magnetic force is 4.5 m-sec. one of the 20 m-sec. of one cycle which is 22.5%, showing a marked reduction as compared with the periods of non-existence of the magnetic force in the pump $P_1$ and $P_2$. Stated differently, the period in which a magnetic force for bringing the electromagnetic movable member 20 into contact with the attracting surface 23 is no less than 77.5% of the 20 m-sec. of one cycle. Thus even if no magnetic force is produced for 4.5 m-sec. as aforesaid, the electromagnetic movable member 20 is almost always kept in contact with the attracting surface 23, thereby avoiding occurrence of chattering and humming. The shortening of the period of non-existence of magnetic force achieved by the present invention would be considered attributed to the action of the aforesaid induced electromotive force tending to compensate for a reduction in magnetic force which is produced by the use of separate coils for the electromagnetic pump and the electromagnetic valve and separation of the magnetic paths 24 and 25 by the non-magnetic portion 26 without the two coils sharing a magnetic path.

From the foregoing description, it will be appreciated that the present invention provides, in a solenoid type electromagnetic pump including a pump actuating coil and a valve operating coil coaxially in adjacent relationship, the structural feature that the magnetic paths adjacent the two coils are axially separated from each other by a non-magnetic portion. The electromagnetic pump provided with this structural feature is free from mutual interference of the magnetic fluxes produced in the two coils, high in operation efficiency, high in reliability, low in chattering and humming produced in the electromagnetic movable member, and free from damage and wear caused to various parts of the pump by noise and chattering.

While the invention has been shown and described by referring to a preferred embodiment thereof, it is to be understood that the invention is not limited to the specific form of the embodiment and that many changes and modifications may be made therein without departing from the scope of the invention.

What is claimed is:

1. In an electromagnetic pump of the built-in electromagnetic valve type and having:

an electromagnetic plunger mounted for slidable reciprocatory movement in a plunger case of non-magnetic material while being supported in balanced condition by the biasing forces of a return spring and an auxiliary spring;

an electromagnetic pump actuating coil disposed in enclosing relation to said plunger case for producing a magnetic flux acting on said electromagnetic plunger through an upper annular magnetic path and an annular magnetic pole;

an electromagnetic movable member disposed in a discharge coupling connected to upper part of said upper annular magnetic path for operating an electromagnetic valve for opening and closing a discharge valve for opening and closing a discharge port of said electromagnetic pump; and, an electromagnetic valve operating coil enclosing said discharge coupling magnetically associated with said electromagnetic movable member and disposed coaxially with said electromagnetic pump actuating coil in adjacent relation thereto for producing a magnetic flux acting on said electromagnetic movable member through a magnetic washer, said upper annular magnetic path and said annular magnetic pole, said electromagnetic valve operating coil have turns wound in the same direction and is connected in series with said electromagnetic pump actuating coil;

the improvement comprising:

a non-magnetic material interposed between a magnetic path of said electromagnetic pump actuating coil and a magnetic path of said electromagnetic valve operating coil to form two separated magnetic loops which are associated with said coils respectively and opposed to each other along said non-magnetic material for nulifying the residual magnetism in order to prevent the leakage of liquid while the pump is at standstill; and, a reduced cross-sectional area portion formed by a groove provided on the outer-periphery of said upper annular magnetic path in a position adjacent to said non-magnetic material to increase the magnetic resistance of said upper path and to increase the separation between the upper and lower loops in order to decrease the mutual interference of magnetic fluxes generated by said coils.

2. An electromagnetic pump as claimed in claim 1, wherein said non-magnetic portion comprises a synthetic resinous material.

3. An electromagnetic pump as claimed in claim 1, wherein said non-magnetic portion comprises a non-magnetic metal plate.

* * * * *